US006145599A

United States Patent [19]

Mumme

[11] Patent Number: 6,145,599

[45] Date of Patent: Nov. 14, 2000

[54] ANTI-COMBUSTION SAFEGUARD FOR CONFINED COMBUSTIBLES

[76] Inventor: Christian F. Mumme, P.O. Box 248, Eastport, Me. 04631-0248

[21] Appl. No.: 09/316,900

[22] Filed: May 22, 1999

[51] Int. Cl.[7] ..... A62C 35/00

[52] U.S. Cl. ..... 169/66; 169/12; 169/62; 220/88.3

[58] Field of Search ..... 169/11, 12, 19, 169/26, 44, 45, 46, 62, 66, 68, 84; 220/88.1, 88.3, 562, 564

[56] References Cited

U.S. PATENT DOCUMENTS

| | | | |
|---|---|---|---|
| 3,606,079 | 9/1971 | Eaton | 220/88.3 |
| 4,319,640 | 3/1982 | Brobell | 169/62 |
| 4,351,394 | 9/1982 | Enk | 169/62 |
| 4,646,848 | 3/1987 | Bruensicke | 169/62 |
| 4,726,426 | 2/1988 | Miller | 169/62 |
| 4,763,731 | 8/1988 | Adams et al. | 169/46 |
| 5,449,041 | 9/1995 | Galbraith | 169/11 |
| 5,850,876 | 12/1998 | Allison et al. | 169/11 |
| 5,918,679 | 7/1999 | Cramer | 169/45 |

*Primary Examiner*—Andres Kashnikow
*Assistant Examiner*—Lisa Ann Douglas
*Attorney, Agent, or Firm*—Charles A. McClure

[57] ABSTRACT

Anti-combuation safeguarding of fuel and other combustible material confined in contact with a pre-existing overlying ambient atmosphere supportive of combustion. Such atmosphere is displaced by an underlying blanketing layer of heavier-than-air gaseous carbon dioxide evolving from solid non-combustible carbon dioxide located at a nearby site, from which it is distributed to site(s) of fuel or other combustible material. Such a method, together with apparatus to implement it, is applicable to fuel or other combustible material not only when stored at a fixed location, but also in a transport vehicle or craft of whatever type, and wherever located. Distributive flow of carbon dioxide to fuel sites in air, land, or marine craft may be accelerated in accordance with fuel consumption, and also in the event of occurrence of a spark or other hazard, as by applying radiation to the solid carbon dioxide so as to increase its existing rate of conversion into carbon dioxide gas.

15 Claims, 2 Drawing Sheets

ANTI-COMBUSTION SAFEGUARD FOR CONFINED COMBUSTIBLES

TECHNICAL FIELD

This invention concerns safeguarding fuel and other combustible material from combustion when confined in contact with an atmosphere supportive of combustion on occurrence of a spark or similar event.

BACKGROUND OF THE INVENTION

Fuels and other combustible materials frequently are stored in contact with air, though it is supportive of combustion, as in event of a spark, an extreme temperature rise, or similar hazardous event. As sustained combustion depends upon continued availability of air or other oxidant source, fire-extinguishing equipment may supply an oxygen-free gas blanketing the affected site to preclude continued combustion. Noble gases, such as argon and helium, are too costly, except for laboratory use. Available oxygen-free candidates include carbon dioxide, nitrogen, and various hydrocarbons, some halogen-containing, some storable in liquid form under pressure, also some rather toxic. Carbon tetrachloride is an old example of the latter.

Fire or explosion in a ground-level facility is bad enough, but may be substantially worse in transport craft, whether on land, or on or in the sea, or in the air, or even in outer space. Transport craft, wherever located, are at the mercy of the adverse effects of such hazards, as within cargo holds, and in communication or control compartments, as well as in fuel tanks, possibly extending also to the near vicinity of the craft, whether under way or even at rest.

Such hazards cannot be completely eliminated, but it is always desirable to have facilities for preventing them wherever possible, and for ameliorating their effect whenever prevention is incomplete.

Among contributions directed to one or more of such concerns, inventors who have received U.S. patents, include Brobeil, U.S. Pat. No. 4,319,640 (1982), Gas Generator-Actuated Fire Suppression Mechanism, wherein a vaporizable liquid such as Halon® [Allied Chemical brand name] is expelled by gas-generation; Enk, U.S. Pat. No. 4,351,394 (1982) Method and System for Aircraft Protection, in which distinct zones, each with its own sensor, are provided with extinguishing fluid via distribution branches as from a central manifold; Bruensicke, U.S. Pat. No. 4,646,848 (1984), Fire Suppression system for an Aircraft, both ducted and portable distribution of Halon® distributed by nitrogen under high pressure; Adams, Grenich, and Tolle, U.S. Pat. No. 4,763,731 (1988) Fire Suppression System for Aircraft, with small frangible spherical containers of pressurized extinguishing gas located throughout a given wing or other compartment; Miller, U.S. Pat. No. 4,726,426 (1988) Fire Extinguishment System for an Aircraft Passenger Cabin, a cargo compartment carries a container of bromotrifluoromethane connected to passenger cabin air-ducts, etc.; Galbraith, U.S. Pat. No. 5,449,041 (1995) Apparatus and Method for Suppressing a Fire, a multiple-gas arrangement, with a first application of a mix of carbon dioxide, nitrogen, and water vapor, thus vaporizing a more conventional material, such as Halon®; and Hindrichs, Koch, and Trey, Fire Protection of Cargo Spaces, with a cargo compartment two-container constant-flow arrangement for a liquid extinguishant.

Notwithstanding the foregoing contributions, the present effort seems appropriate, to improve means and methods of hazard protection for storers of fuel and similarly combustible materials, especially for all users of transport craft, whether in air or on land or sea, to the benefit of their craft and their immediate surroundings also.

SUMMARY OF THE INVENTION

A primary object of the present invention is to enhance safety of storage of fuel or other hazardous material, possibly in cargo, confined in contact with an ambient atmosphere, such as air, supportive of combustion in the event of a spark or other hazardous event.

Another object of this invention is to furnish novel methods and means for providing and distributing a fire-prevention gas.

A further object is to provide preventive, as well as remedial, fire protection against fuel-induced hazards in tanks and containers as well as in all types of combustion-driven transport craft.

Yet another object of this invention is to accomplish the foregoing objects with readily available material very economically.

In general, the objects of the present invention are attained where fuel, or other combustible material, is confined in contact with air or other atmosphere supportive of combustion, as upon the occurrence of a spark or similarly hazardous event, by displacing the adjacent atmosphere with a replacement blanket of gaseous carbon dioxide (prior to ignition) conducted from nearby solid carbon dioxide—which lacks any liquid phase at standard temperature and pressure, and sublimes from solid to gaseous phase well below human life-supporting temperature. Gaseous carbon dioxide, being about half again as dense as air, will readily displace air at the lowest level of the ambient atmosphere.

More particularly, as in a transport craft, fuel compartments are continuously blanketed with gaseous carbon dioxide, having been conducted via one or more suitable passageways from one or more blocks of solid carbon dioxide.

Other locations to be so protected in the craft are interconnected to such a source of carbon dioxide via an appropriate network of appropriate passageways, preferably having one-way valves to preclude back-flow of fumes, etc. from the protected locations.

Fuel tanks are preferably monitored continuously by appropriate sensors to indicate consumption rate and any unusual change therein requiring an increase in flow of gaseous carbon dioxide above its ambient rate of sublimation, to keep air out of the tanks. Fuel tanks and cargo holds preferably are similarly monitored for hazardous occurrences, such as a spark or unexpected increase in temperature or pressure.

In such event, additional gaseous carbon dioxide is provided as by exposing the solid carbon dioxide to radiation, if not already being so exposed—or to more radiation if already so exposed—so as to raise its temperature appreciably and thereby to stimulate more rapid conversion of carbon dioxide from solid into gaseous form.

A radio-frequency (RF) radiation source is preferred, which may be embodied in a magnetron, for example, at or about the entry end of a passageway in the carbon dioxide distribution network. Pumping of gaseous carbon dioxide through the passageway(s) may be initiated, or may be accelerated if such pumping is already under way.

Other objects of this invention, together with methods and means for attaining the various objects, will become apparent from the following description and the accompanying diagrams of at least one embodiment, presented by way of example rather than limitation.

DESCRIPTION OF THE INVENTION

Although a tank farm or another less demanding storage location can benefit from this invention, the embodiment described and shown here is considered to be preferable in an appreciably more demanding environment, such as a transport vehicle, where fuel is subject to being consumed over time, and where usually substantial cargo space poses another site for protection against fire or explosion hazard, as may electronics equipment in communication and/or control rooms.

Figure 1:
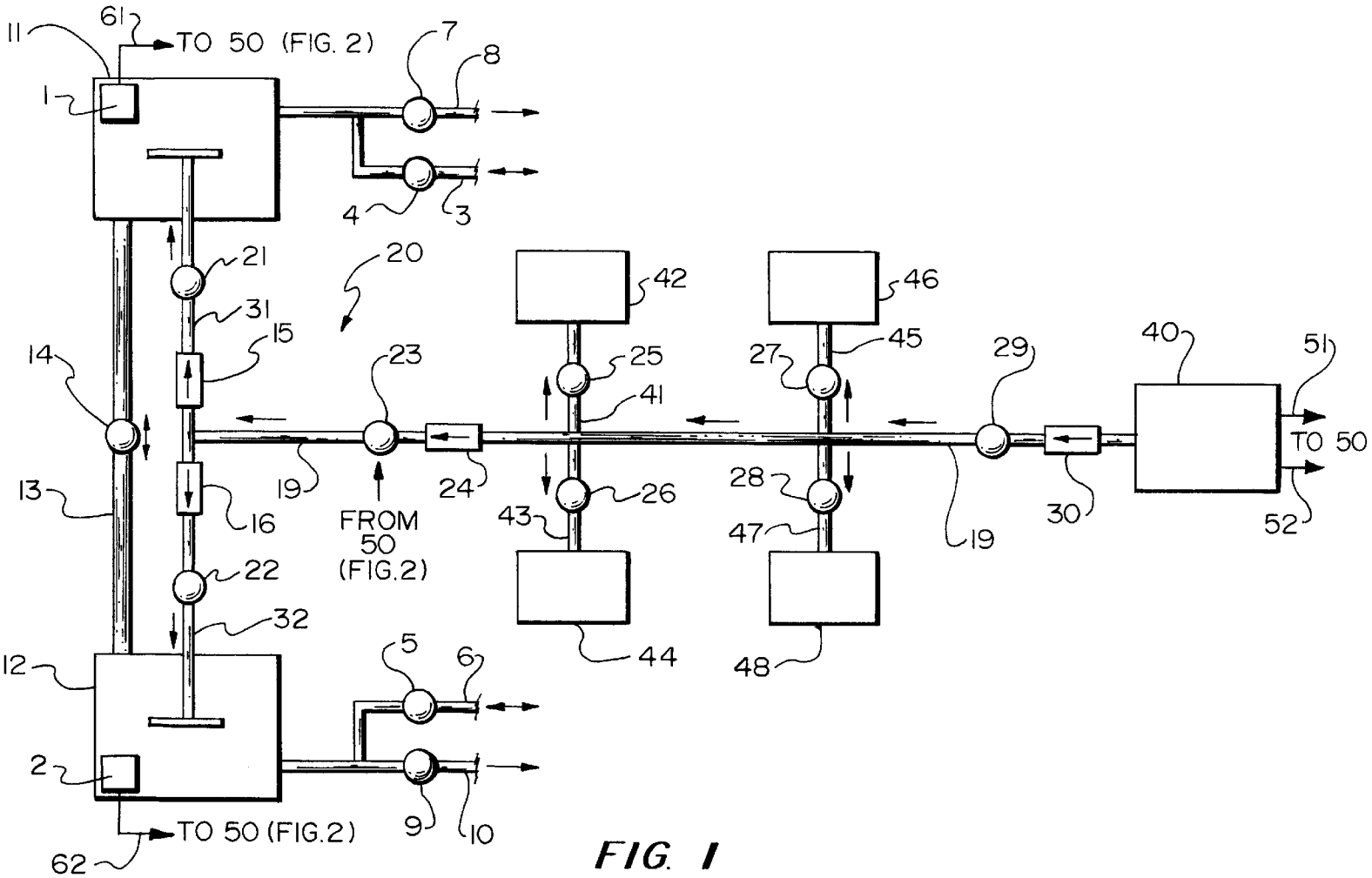
FIG. 1 is a schematic plan view of an exemplary embodiment of distribution piping system for gaseous carbon dioxide, from a source comprising solid carbon dioxide, according to this invention.

FIG. 1 shows schematically a preferred embodiment of this invention featuring distribution system 20, wherein solid carbon dioxide source 40 is connected to protected sites, via pipelines ("pipes" or "lines") shown double-lined, having flow-regulating valves (circles) and check valves (rectangles with enabled flow-direction arrows).

Fuel tanks 11 (e.g., starboard) and 12 (e.g., port) are joined together by fuel intermediate transfer line 13 provided with two-way transfer valve 14 (with double arrow) Each fuel tank is provided with a customary filler/vent valve and an additional over-pressure relief valve: tank 11 with vent valve 4 in filler line 3, and overpressure valve 7 in relief line 8; and tank 12 with vent valve 5 in filler line 6, and over-pressure valve 9 in relief line 10.

Each tank (whose air is to be displaced by a carbon dioxide atmosphere above the fuel level) has a distribution pipe (with T-end) connected from the end of main distribution pipe 19: pipe 31 to tank 11 having check valve 15 and flow-regulating valve (or just "regulator") 21; and tank 12 having such pipe 22, with check valve 16 and regulator 22.

Instruments—1 in tank 11, 2 in tank 12—monitor the internal atmospheric composition, temperature, and pressure, changes therein over time, and sparking or other hazards, and connect to controller 50 (FIG. 2) by lead 61 from tank 11, and by lead 62 from tank 12.

Main distribution line 19 originates at carbon dioxide source 40 (far right) and proceeds (leftward) to first check valve 30, then first flow-regulating valve 29, to successive junctions with a first pipeline pair 45 and 47, and then a second pipeline pair 41 and 43. At the first junction, pipe 45 containing flow-regulating valve 27 (check valve optional in each similar instance) leads to protected compartment 46, whereas pipe 47 containing regulator 28 connects to protected compartment 48. At the next junction pipe 41 containing regulator 25 leads to protected compartment 42, and pipe 43 having regulator 26 connects to protected compartment 44. The main distribution line continues through check valve 24 and regulator 23 to previously noted junction with pipes 31 and 32 to the fuel tanks.

The protected compartments (other than fuel tanks) conveniently comprise cargo compartment or hold 42, communications compartment or panel room 44, control compartment or panel room 46, and perhaps even food storage compartment or room 48 occupied only temporarily by personnel. Distribution of carbon dioxide to quarters occupied regularly by crew or passengers is not recommended because of the deleterious effects of its excessive inhalation upon human systems, even where auxiliary oxygen supply facilities have been provided, but may be used in munitions compartments, for instance, where breathing apparatus is supplied to the crew members prior to entry.

Figure 2:
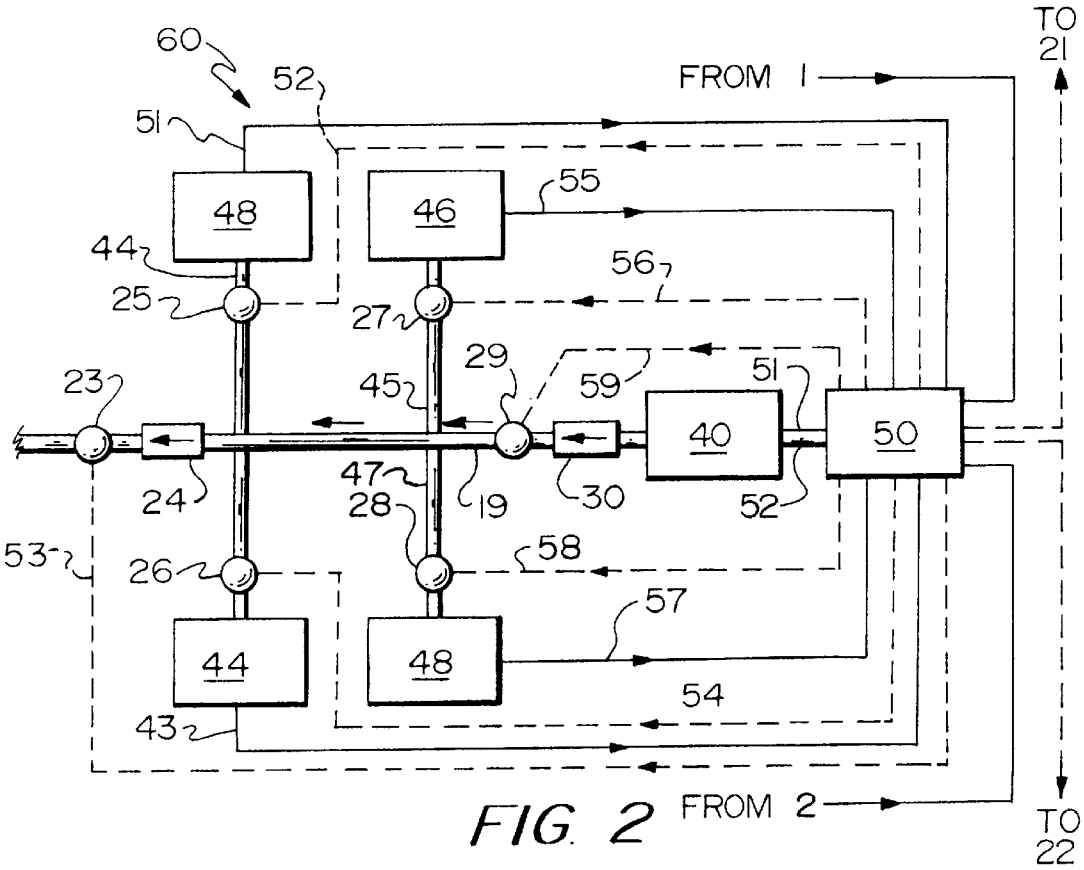
FIG. 2 is a schematic portrayal of a hazard sensing and control system paralleling the distribution system.

FIG. 2 schematically shows flow-monitoring and control system 60 of the invention, featuring master controller 50 connected (by single solid lines) from FIG. 1 fuel tank monitors 21 and 22, as just noted, and connected likewise from protected compartments 42, 44, 46, and 48 by respective monitoring lines 51, 53, 55, and 57. The master controller analyzes the received data and transmits flow adjustments (via interconnecting dashed lines) to joint regulator valve 23 in main line 19 and on to individual regulators 21 and 22 in lines 31 and 32 to respective fuel tanks 11 and 12.

Master controller 50 also receives like data from the protected compartments 42, 44, 46, and 48 via interconnecting lines 52, 54, 56, and 58, so as to to control flow by making adjustments to flow-regulating adjustments at regulating valves 25, 26, 27, and 28 in respective lines 41, 43, 45, and 47. The master controller connects also to solid carbon dioxide source 40 to monitor its conditions of temperature and pressure via line 51 and to adjust them via line 52.

Figure 3:
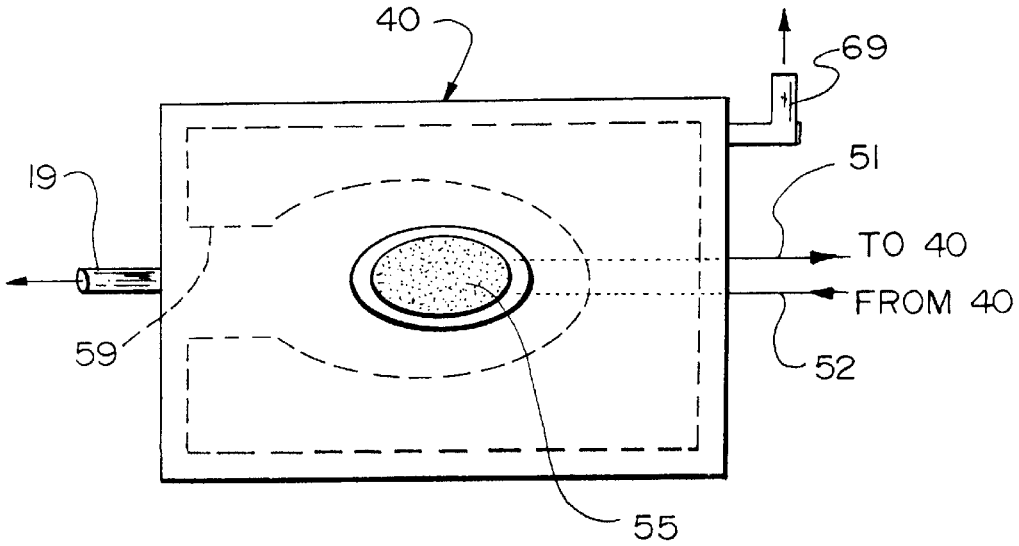
FIG. 3 is a mainly schematic view of at least one source block of solid carbon dioxide, plus an adjunct radio-frequency heating source, at an entry to the distribution system.

FIG. 3 schematically shows representative source block 59 of solid carbon dioxide located at the extreme end of entry pipe 19 to the distribution system. Also shown is adjunct heating source 55 (here shown centrally located) responsive to master control unit 50, as just noted, via leads 51, 52 to heat the surrounding solid carbon dioxide block 59 (broken lines), thereby accelerating its conversion into gaseous carbon dioxide and its piped distribution where needed.

Sublimation from solid to gaseous carbon dioxide takes place continuously at exposed surfaces of the block and is accentuated by increasing radiation onto the exposed portion (s) of the block, here preferably a central part tunneled out to enable an interior source. The tunnel is not bored but is created by placement of blocks of the solid carbon dioxide in a suitably surrounding "tunnel" arrangement. Over-pressure vent 59 to the outer atmosphere is a safety feature, and more than one such vent may be desirable.

It will be understood that the illustration is schematic in the sense that operative arrangements may range between the extremes of (a) having a solid carbon dioxide block centered in an enclosure lined with a radiation sources, to (b) having a source of radiation centered in an enclosure lined with layers of solid carbon dioxide, or (c) a selected combination of (a) and (b) or an alternative. A useful arrangement is a radio-frequency radiator, e.g., a magnetron, but a network of resistance heating elements could be acceptable.

The specific embodiment shown in FIG. 3 illustrates central heating, as by a centrally located source of radio-frequency (RF) radiation 55, such as a magnetron 55, surrounded by and seemingly tunneling through—or similarly affecting—block 59 of solid carbon dioxide. Such arrangement is preferred, partly becauses it exposes to relatively omni-directional radiation a substantial surface area of the solid carbon dioxide that is evolving or to evolve into gas.

Although air, land, and sea (including submersible) transport vehicles differ from one another, this arrangement is adaptable to all of them or even to a relatively fixed fuel storage facility, by means of appropriate piping, monitoring, and control facilities.

Operation of the present invention is readily understood by reference to the foregoing description of the accompanying drawings.

In normal operation, the regulator valves for the fuel tanks, plus the main regulator valve from the solid carbon dioxide source to the distribution system, are partly open to enable some gaseous carbon dioxide to flow from the slowly subliming solid source, so as to blanket the fuel in the tanks as the fuel level decreases during operation of the transport vehicle. The regulator valves in other lines are normally closed in the absence of a sensed condition at any monitored site in the distribution system that suggests opening such a valve to enable flow of gaseous carbon dioxide to the site.

The monitoring system is continuously sensing and evaluating critical features of ambient pressure and temperature, at all sites. Whenever an anomalous value of any of these or a spark, for example, occurs, an identifying signal is transmitted to the master monitor. If its evaluation urges action, the radiation source is activated, and all site distribution system regulator valves in the piping to that site are opened to increased flow of gaseous carbon dioxide therethrough.

If the main electrical system should be affected, the valves and the RF source are actuatable from a battery power supply (not shown), a common precautionary feature in fire-prevention systems.

This invention does not require any scarce or unusual materials or methods of construction. Solid carbon dioxide is a known article of commerce and is often employed as a refrigerant or cooling aid. Sensors of atmospheric pressure and temperature and of changes in such characteristics are readily available, as are spark detectors. Plumbing of check valves and flow-regulatingvalves is well known, and ordinarily skilled artisans can adapt almost any known transport means to utilize the anti-combustion safeguards of this invention.

Accordingly, practicing the present invention is inexpensive, and indeed may be profitable by way of reducing insurance charges and/or saving expensive communications and transportation facilities from damage or destruction irrespective of any saving in human life.

Advantages and benefits of the apparatus arrangement and method procedures of this invention have been mentioned in the foregoing description, and others doubtless will accrue to those persons and organizations that have an opportunity to experience them.

One or more embodiments and variants have been suggested for means and methods of this invention. Other modifications may be made, as by adding, combining, deleting, or subdividing compositions, parts, or steps, while retaining at least some significant advantages and benefits of the present invention—which itself is defined in the following claims.

What is claimed is:

1. Safeguard apparatus for fuel or other combustible material confined in contact with an ambient atmosphere that is supportive of combustion upon occurrence of a spark or similarly hazardous event, comprising:

solid carbon dioxide, at whose surface heavier-than-air gaseous carbon dioxide evolves, for distribution to a site of confined fuel or combustible material, where it is capable of displacing ambient atmosphere from such contact;

an access passageway conductive of such gaseous carbon dioxide, from the site of the solid carbon dioxide, to the site of confined fuel or other combustible material, where ambient atmosphere is to be displaced from such contact, to prevent or to arrest combustion;

including at the confined site a sensor sensitive to a spark or to an increase in atmospheric temperature or pressure, as a potentially hazardous condition to be reported from the sensor to, and be evaluated by, a central monitor, near the site of the solid carbon dioxide and sensitive to conditions at the site of the confined fuel or combustible material and adapted to control the evolution of the gaseous carbon dioxide.

2. Safeguard apparatus according to claim 1, wherein the central monitor is effective to expedite increased generation of evolved gaseous carbon dioxide and distribution thereof via such passageway to any site where a potentially hazardous condition is sensed.

3. Safeguard apparatus, for fuel or other combustible material confined in contact with an ambient atmosphere that is supportive of combustion upon occurrence of a spark or similarly hazardous event, comprising:

solid carbon dioxide, at whose surface heavier-than-air gaseous carbon dioxide evolves, for distribution to a site of confined fuel or combustible material, where it is capable of displacing ambient atmosphere from such contact;

an access passageway conductive of such gaseous carbon dioxide, from the site of the solid carbon dioxide, to the site of confined fuel or other combustible material, where ambient atmosphere is to be displaced from such contact, to prevent or arrest combustion;

including at the site of the solid carbon dioxide a radiation source responsive to the central monitor and effective to radiate onto the solid carbon dioxide and thereby increase the current rate of evolution of gaseous carbon dioxide therefrom, to prevent or to arrest combustion.

4. Safeguard apparatus according to claim 3, wherein the radiation source is an emitter of radio-frequency radiation.

5. Safeguard apparatus according to claim 4, wherein the radiation source comprises a magnetron.

6. Transport craft safeguard, comprising:

an on-board supply of solid carbon dioxide, susceptible of evolving at ambient temperature into gaseous carbon dioxide as a protective agent to displace a pre-existing ambient atmosphere supportive of combustion from continuing contact with fuel or other combustible material;

an on-board source of radiation near the site of the supply of solid carbon dioxide and capable of increasing radiation onto the solid carbon dioxide and so increasing the rate of evolution of gaseous carbon dioxide therefrom.

7. Safeguard apparatus according to claim 6, wherein the site of the confined fuel or other combustible material is in an immovable storage location.

8. Safeguard apparatus according to claim 6, wherein the site of the confined fuel or other combustible material is in a transport craft.

9. Transport craft safeguard according to claim 6, including at least one passageway interconnecting the evolved gaseous carbon dioxide for distribution to an on-board site containing fuel or other combustible material to displace its pre-existing ambient atmosphere supportive of combustion from such continuing contact.

10. Transport craft safeguard according to claim 6, wherein such passageway connecting the carbon dioxide to such site has a flow-control valve and a back-flow check valve also.

11. Transport craft safeguard according to claim 6, wherein each such site of fuel or other combustible material includes a sensor, sensitive to a spark or an increase in the pressure or the temperature of the ambient atmosphere, and operatively connected through a central monitor to radiation means for increasing the rate of evolution of gaseous carbon dioxide and the rate of distribution thereof to the sensed site via such passageway to such site.

12. Transport craft safeguarded according to claim 11, wherein the radiation means comprises a magnetron.

13. Method of safeguarding a given site of confined fuel or other combustible material in contact with a pre-existing ambient atmosphere supportive of combustion, comprising the following steps:

evolving gaseous carbon dioxide from a nearby supply of solid carbon dioxide, distributing gaseous carbon evolved therefrom to the site of the confined fuel or other combustible material to blanket the site and displace such pre-existing ambient atmosphere from such contact; and subjecting the solid carbon dioxide to radiation thereonto, and thereby increasing evolution of gaseous carbon dioxide for such distribution to the site of fuel or other combustible material.

14. Method according to claim 13, including the step of providing such radiation at least in part from a radio-frequency radiation source.

15. Transport aircraft safeguarded by the method of claim 13.

* * * * *